US007431534B2

(12) United States Patent
Harbeck

(10) Patent No.: US 7,431,534 B2
(45) Date of Patent: Oct. 7, 2008

(54) FLOOD PROTECTION

(75) Inventor: Rudolf Harbeck, Bad Birnbach (DE)

(73) Assignee: Big Bag Harbeck GmbH, Bad Birnbach (DE)

( * ) Notice: Subject to any disclaimer, the term of this patent is extended or adjusted under 35 U.S.C. 154(b) by 195 days.

(21) Appl. No.: 11/444,715

(22) Filed: Jun. 1, 2006

(65) Prior Publication Data

US 2006/0275084 A1 Dec. 7, 2006

(30) Foreign Application Priority Data

Jun. 6, 2005 (DE) ..... 10 2005 025 918

(51) Int. Cl.
*E02B 7/02* (2006.01)

(52) U.S. Cl. ..... 405/114; 405/107; 405/115

(58) Field of Classification Search ..... 405/107, 405/114, 115, 116
See application file for complete search history.

(56) References Cited

U.S. PATENT DOCUMENTS

| | | | | | |
|---|---|---|---|---|---|
| 3,213,628 | A * | 10/1965 | Serota | 405/111 |
| 4,362,433 | A * | 12/1982 | Wagner et al. | 405/107 |
| 4,499,599 | A * | 2/1985 | Polett et al. | 383/6 |
| 4,650,368 | A * | 3/1987 | Bayer | 405/111 |
| 4,807,299 | A * | 2/1989 | Nattrass et al. | 383/109 |
| 5,423,611 | A * | 6/1995 | Sherrard | 383/24 |
| 5,584,599 | A * | 12/1996 | Knittel | 405/15 |
| 5,685,450 | A * | 11/1997 | Uda | 220/495.01 |
| 5,971,661 | A * | 10/1999 | Johnson et al. | 405/114 |
| 6,164,870 | A * | 12/2000 | Baruh | 405/115 |
| 6,390,154 | B1 * | 5/2002 | Hall | 405/107 |
| 6,491,431 | B2 * | 12/2002 | Merten | 405/114 |
| 6,715,960 | B2 * | 4/2004 | Metz | 405/114 |
| 2001/0002675 | A1 * | 6/2001 | Wilcox | 222/95 |
| 2007/0140598 | A1 * | 6/2007 | McGillick et al. | 383/22 |
| 2007/0237586 | A1 * | 10/2007 | Prestininzi | 405/115 |

FOREIGN PATENT DOCUMENTS

| | | | |
|---|---|---|---|
| DE | 19738216 | | 3/1999 |
| DE | 20118808 | U1 | 4/2002 |
| DE | 20213118 | U1 | 11/2002 |
| DE | 20217317 | U | 2/2003 |
| DE | 20302290 | U1 | 5/2003 |
| DE | 10239249 | | 3/2004 |
| DE | 202004003567 | U1 | 6/2004 |
| EP | 0735198 | | 10/1996 |
| EP | 1009883 | | 6/2000 |
| EP | 1418276 | | 5/2004 |
| FR | 2526127 | | 11/1983 |
| GB | 2197902 | A | 6/1988 |
| GB | 2326428 | | 12/1998 |
| JP | 2007091315 | A * | 4/2007 |

* cited by examiner

*Primary Examiner*—Frederick L Lagman
(74) *Attorney, Agent, or Firm*—Gifford, Krass, Sprinkle, Anderson & Citkowski, P.C.

(57) ABSTRACT

The invention relates to flood protection comprising a plurality of fillable sacks made of flexible fabric material, with mutually adjacent coupling sides of adjacent sacks being connected to one another in a coupling region and with at least one stiffening structure being associated with each coupling region and extending from the base region of the sacks up to their upper marginal region.

25 Claims, 3 Drawing Sheets

Fig. 1
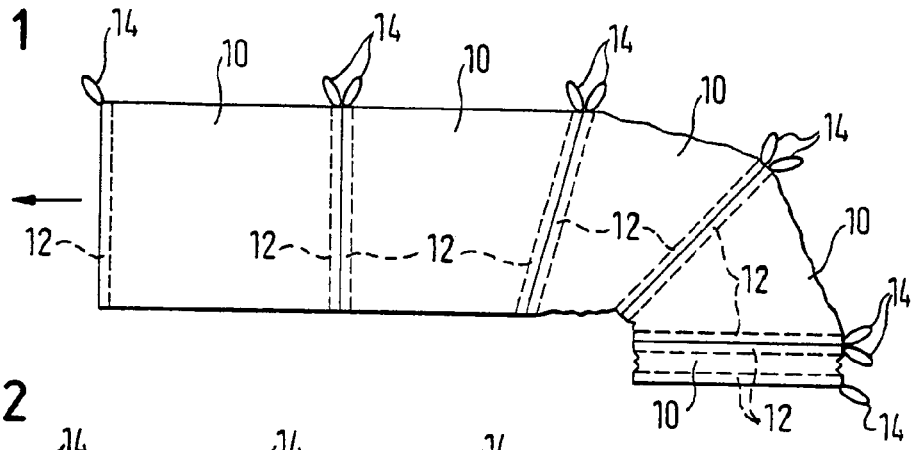
Fig. 2
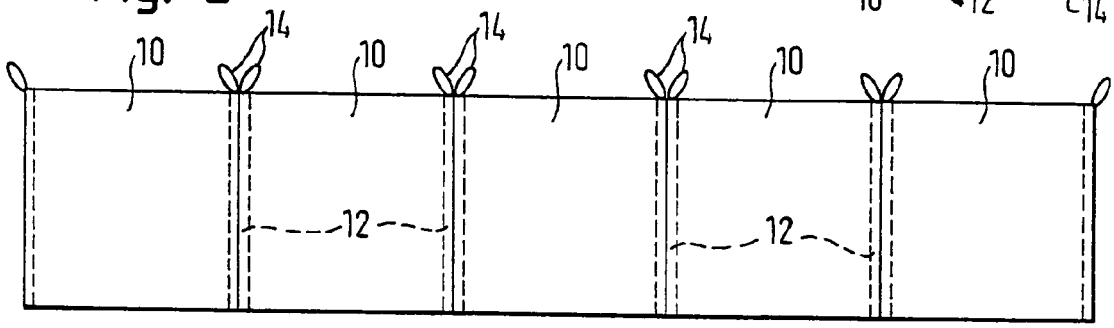
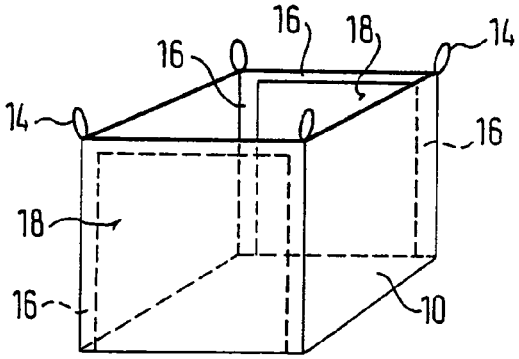
Fig. 3
Fig. 4
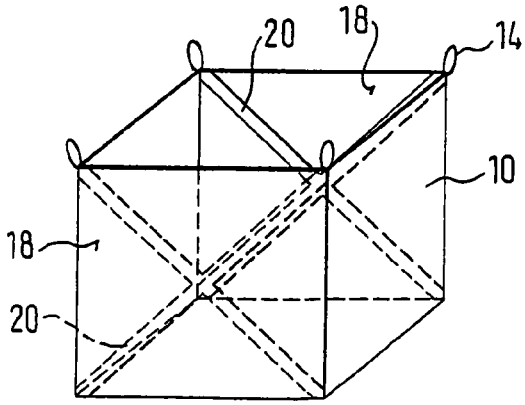

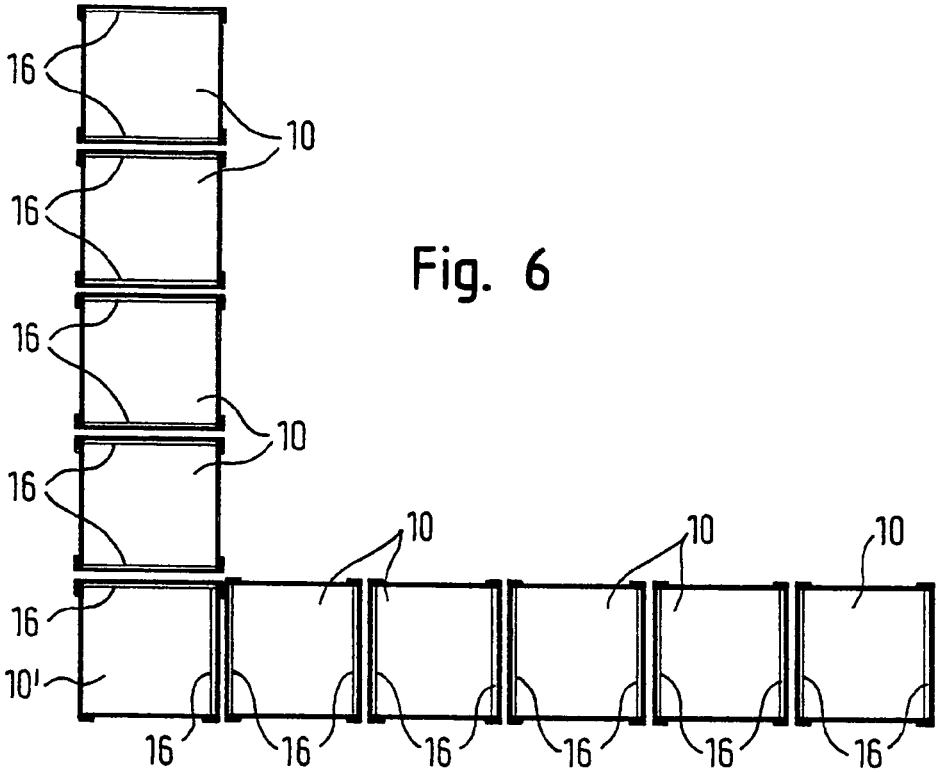
Fig. 6
Fig. 7
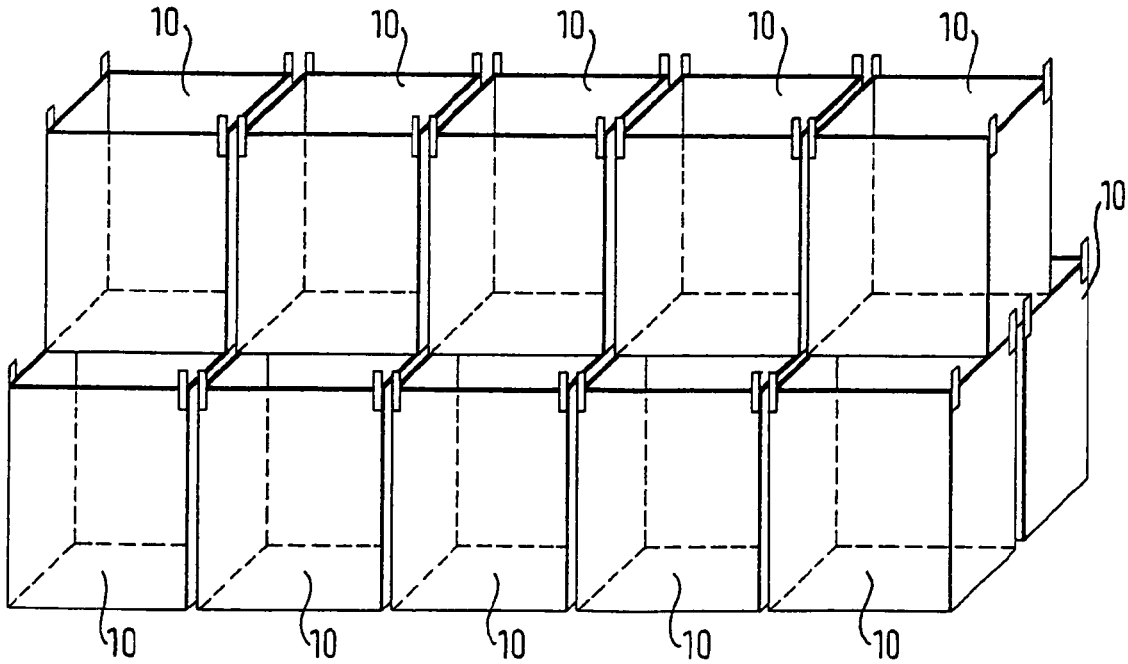

FLOOD PROTECTION

CROSS-REFERENCE TO RELATED APPLICATIONS

This application claims the benefit of German Patent Application No. 10 2005 025 918.9, filed on Jun. 6, 2005. The disclosure of the above application is incorporated herein by reference.

FIELD OF THE INVENTION

The invention relates to flood protection comprising a plurality of fillable sacks consisting of flexible fabric material.

BACKGROUND OF THE INVENTION

Sacks filled, for example, with sand have already been used for a long time for flood protection, with the problem regularly occurring of filling the sacks fast enough and then transporting them from the filling location to the respectively desired use location. The size of the sacks is usually dimensioned such that they can still be carried by one person in their filled state, which disadvantageously has the result that flood protection has to be built up of a comparatively large number of individual sacks.

SUMMARY OF THE INVENTION

It is an underlying object of the invention to further develop flood protection of the initially named kind such that it can be erected fast and simply in a cost-favorable manner directly at the respective use location.

This object is satisfied in accordance with the invention in that mutually adjacent coupling sides of adjacent sacks are connected to one another in a coupling region, and in that at least one stiffening structure is associated with each coupling region and extends from the base region of the sacks up to their upper marginal region.

Since the sacks connected to one another in accordance with the invention have stiffening structures at their coupling sides, a unit consisting of a plurality of sacks can be set up directly at the respective use location without problem in their unfilled state, with the stiffening structures ensuring that the shape of the unfilled sacks does not substantially differ from the shape of the filled sacks. After the setting up of a unit consisting of a plurality of sacks, they can then be filled simply and fast from above with a suitable medium, for example with sand or with a sand and gravel mixture. It is of advantage in this connection that the sacks in accordance with the invention can be equipped with a comparatively large upper opening so that the filling procedure can be carried out extremely fast.

After the end of the filling procedure, the unit in accordance with the invention consisting of a plurality of sacks is already located at the designated use location since it was already able to be transported there in the unfilled state prior to the filling. In this respect, in accordance with the invention, an energy consuming and time consuming transport of already filled sacks is completely avoided, which likewise represents a substantial time advantage.

Since, in accordance with the invention, a plurality of sacks combined to form a unit are coupled to one another, the setting up of the unfilled sacks can likewise be affected extremely fast, since for this purpose only the two outer sacks of a unit have to be gripped and pulled in opposite directions. Subsequently, the sacks are then already simply held in this pulled-apart position either by the stiffening structures in accordance with the invention or by persons, whereupon the filling can take place. If the sacks are held in the pulled-apart position only by the stiffening structures in accordance with the invention, they ensure that the sacks cannot collapse or slip. It is of advantage in this connection that no persons have to be in the vicinity of the sacks on the filling so that no risks for persons result from the filling process.

In the process of filling, it is furthermore of advantage that it can be carried out practically without interruption with respect to a unit consisting of a plurality of sacks with a constantly flowing flow of filler medium since a corresponding filler stub simply has to be moved over the directly mutually adjacent openings of the sacks coupled to one another so that the individual sacks are filled sequentially extremely fast during this movement. It is not necessary in this connection—as mentioned—to interrupt the flow of filler medium when changing from one sack to an adjacent sack.

In accordance with the invention, various possibilities exist to couple the sacks to one another.

Mutually adjacent coupling sides of adjacent sacks can be connected to one another in a preferred embodiment of the invention by means of a force-transmitting connection between the two stiffening structures of the respective coupling sides, in particular by means of screws, nails, clamps, bands and/or C-clamps. This force-transmitting connection is preferably provided in regions of the stiffening structures close to the opening and additionally close to the base. In this manner, a particularly good sealing effect between adjacent sacks results over their total height.

It is, however, also equally possible to connect mutually adjacent coupling sides of adjacent sacks to one another in that the sack material of the adjacent sacks is coupled to one another, in particular by sewing or by means of hook and loop connections. The stiffening structures can consist in such a case e.g. of bars which are inserted into corresponding loops of the sacks.

Finally, it is furthermore possible to connect mutually adjacent coupling sides of adjacent sacks to one another in that the sack material of the one sack is coupled to the stiffening structure of the other sack, in particular by means of clamps, nails, screws or the like.

In the two last-named variants, it is sufficient for a stiffening structure only to be associated with one of two mutually connected coupling sides.

It is generally of advantage for mutually adjacent sacks to be connected to one another in the region of the total length of the upper margin of their coupling sides since it can thus be avoided that filler material comes between two coupled sacks.

It is preferred for at least one sack, in particular each sack, to be provided with one stiffening structure each at two mutually opposite sides or at two mutually adjacent sides. In this manner, with sacks having one stiffening structure each at two mutually opposite sides, a plurality of sacks can be coupled to one another within the framework of a unit in the form of an elongate row, which is desirable as a rule in the setting up of flood protection. When a sack is used which is equipped with one stiffening structure each at two mutually adjacent sides, an elongate row can be set up with a kink which can e.g. amount to 90 ° in the region of the said sack. This will be explained in more detail within the framework of the description of the Figures.

The stiffening structures can essentially extend within one plane so that they in particular substantially completely span the coupling sides of the sacks. This then has the result that the coupling sides extend within one plane so that the mutually facing coupling sides of two mutually adjacent sacks can come into contact with one another over the full area as much as possible, which ultimately has the result that a good sealing effect is achieved between mutually adjacent sacks. A particularly good sealing effect between two mutually adjacent sacks results when the stiffening structures are each arranged at the insides of the sacks.

The stiffening structures can generally have any desired shape, with a U shape being preferred whose base extends along the upper margin of a coupling side. In this connection, the two parallel limbs of the U shape extend substantially vertically downwardly with a filled sack. Furthermore, the stiffening structures can also have the form of a rectangular frame, in particular a square frame, or a T-shape or cross-shape. When a U-shaped or rectangular stiffening structure is used, the area bounded by the stiffening structure substantially corresponds to the periphery of the respective coupling side so that the stiffening structure can actually also span the total coupling side. When a cross-shape is used, the two elements of the stiffening structure extending at right angles to one another have a length which in each case corresponds to a diagonal of the respective coupling side in order also to be able to ensure a complete spanning of the coupling side in this case.

The stiffening structures can consist of any desired materials, in particular of wood, plastic, paper, cardboard, rubber, natural rubber or metal. When plastic is used, the use of cost-favorable recycled plastic is a preferred option since no demands have to be made on the stiffening structures used from a visual respect. The use of pressed paper or cardboard is also possible since the stiffening structure only has to satisfy its stabilizing function during the filling of the sacks and can easily dissolve again subsequently on contact with water.

The force-transmitted connection between the two stiffening structures of mutually adjacent coupling sides of two sacks can be realized by means of screws, nails and/or clamps. On the use of screws or nails, they are, for example, introduced into a stiffening structure from the inside of the sack, for example, until they subsequently pass through the fabric material of the two mutually contacting coupling sides of the mutually adjacent sacks, whereupon they are finally introduced into the stiffening structure of the second sack so that ultimately the desired coupling results of the two stiffening strictures with the fabric materials of the two sacks arranged therebetween.

It is advantageous for the mutually adjacent coupling sides of two sacks to be aligned with one another since they are then mutually adjacent with a surface of maximum size, which in turn permits a good sealing effect.

The sacks substantially have the shape of an upwardly open cube or parallelepiped in their filled state such as is the case, for example, with commercial "Big-Bags". Cube-shaped or parallelepiped-shaped sacks can be set up particularly easily in the form of a row, with respectively equally sized coupling sides being adjacent to one another. The sacks used preferably have mutually equal sizes. Side lengths between 50 cm and 150 cm are sensible here.

It is particularly advantageous for each sack to be made free of stiffening at those sides which extend perpendicular to the coupling sides. This then permits a placing of the unfilled sacks together in the smallest possible space. Specifically, on a stacking of the unfilled sacks, basically only the space for the stiffening structures of the coupling sides lying over one another is required since the remaining sides can be folded together in a very small space. The flood protection in accordance with the invention can thus be stored in a cost-favorable manner, on the one hand, and also be transported very simply, on the other hand, in the unfilled state.

Each sack can be provided with holding loops at its marginal region adjacent to the upper side, with it being preferred for a respective holding loop to be provided in all four corner regions of the open upper sides of the sacks. However, only one holding loop can also extend from the center of an upper marginal side up to the center of the oppositely disposed upper marginal side of a sack or two holding loops can be provided per sack, with each holding loop extending from one corner of the open upper side up to another corner of the open upper side.

At the said holding loops, a unit consisting of a plurality of sacks can be pulled apart directly before the process of filling and can be held during the filling, with in each case always only the two outer loops of the outermost sacks of a unit consisting of a plurality of sacks being required for this procedure of the pulling apart and holding—when four holding loops are provided per sack.

The said holding loops are furthermore of advantage in the dismantling of the flood protection since the filled sacks can be gripped and raised via the holding loops, by means of a suitable lifting device for example, with a sufficient load-bearing capacity of the sacks and of the holding loops. When the raised sacks are subsequently moved, for example over the load surface of a truck, a cutting open of the lower side of the sacks can result in a particularly simple emptying of the sacks. The emptied medium, for example sand, can then be reused or disposed of without problem in this case.

If the stiffening structures of adjacent sacks are connected to one another by means of screws, nails or clamps, it is of advantage for the dismantling of the flood protection that the said connection elements simply tear off on the raising of a filled sack, without the sacks being damaged in this process. The individual sacks can thus be raised individually in sequence and can be emptied in a suitable manner, without any effort having to be expended with respect to the releasing of adjacent sacks from one another. This advantage is e.g. not present with sacks sewed to one another since in this case the seams have to be cut open in a complex procedure.

The sacks are preferably made of water-permeable fabric. Alternatively, however, water-tight fabric can also be used. When sand or a sand and gravel mixture is used as the filler material, water-permeable fabric should be used. The use of polypropylene fabric or jute is particularly preferred.

The flood protection in accordance with the invention preferably consists of a plurality of units which in turn each consist of a plurality of sacks coupled to one another in row form. In this manner, comparatively long dams can also be erected comparatively fast in that a plurality of units in accordance with the invention are filled sequentially in the already described manner. A unit can consist of three to ten sacks, in particular of four to six sacks, and preferably of five sacks. If comparatively high dams have to be set up, it is possible to stack the said units in a pyramid shape.

The invention also comprises a method for the filling of flood protection which consists of a plurality of sacks and in which the filler material is introduced into the individual sacks in two or more filling steps, with all sacks of a unit first being partly filled in a first filling step and a complete filling only taking place within the framework of at least one further filling step. In this manner, too strong a bulging of the sacks and damage to the stiffening structures are effectively avoided.

The filling can take place in at least two steps in that a filler stub or filler tube is moved over mutually adjacent sacks in a first direction, whereupon the filler stub or the filler tube is subsequently moved over the mutually adjacent sacks in a second direction opposite to the first direction.

Finally, the invention also comprises a method for the removal of flood protection consisting of a plurality of sacks in which the sacks are raised individually while destroying the connection present between adjacent sacks, are moved over a load surface and cut open in order thus to empty the respective sack content over the load surface.

Further preferred embodiments of the invention are recited in the dependent claims.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a side view of a unit in accordance with the invention consisting of a plurality of sacks during the erection;

FIG. 2 is a representation in accordance with FIG. 1 in which the unit has been fully erected;

FIG. 3 is a three-dimensional representation of a sack in accordance with the invention such as can be used in an arrangement in accordance with FIGS. 1 and 2;

FIG. 4 is a representation in accordance with FIG. 3 with stiffening structures modified with respect to FIG. 3;

FIG. 6 is a plan view of an arrangement of two units, consisting in each case of five sacks, which jointly form an L structure; and FIG. 7 is a three-dimensional representation of a pyramid-shaped arrangement of a total of three units in accordance with the invention.

DETAILED DESCRIPTION OF THE PREFERRED EMBODIMENTS

Figure 5A:
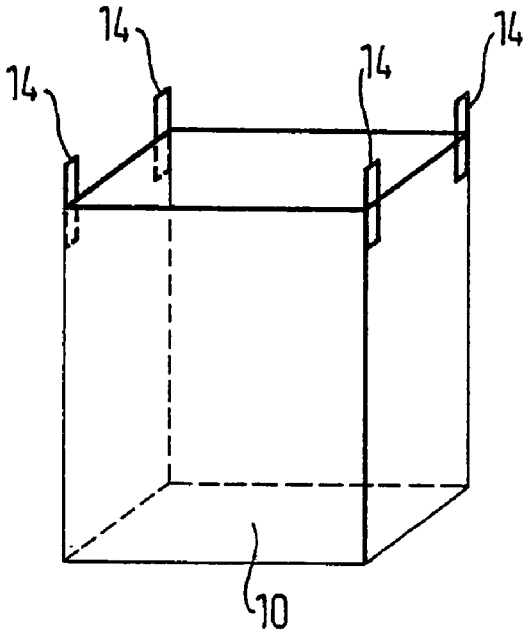
FIGS. 5*a* to *c* are three-dimensional representations of sacks in accordance with the invention with different arrangements of holding loops.

The following description of the preferred embodiment is merely exemplary in nature and is in no way intended to limit the invention, its application, or uses.

FIG. 1 shows a unit in accordance with the invention consisting of five sacks 10 during the erection of the still unfilled sacks 10.

Each sack 10 has a cube shape which is completely open in the erected state, with in each case only one side of this cube shape being able to be seen in the representation of FIG. 1. The cube-shaped sacks are thus closed at the lower side and at all four side faces, but upwardly open.

The sacks 10 are each provided at the inside at two mutually oppositely disposed sides with a stiffening structure 12 in the form of a reversed "U", which is suitable to span the corresponding sides of the sacks completely and thus to avoid the still unfilled sacks 10 from collapsing. The sides of the sacks 10 provided with stiffening structures 12 form the coupling sides in accordance with the invention with which the adjacent cube-shaped sacks 10 are adjacent to one another. Mutually adjacent sacks 10 are connected to one another by means of screws (not shown) which extend through the stiffening structures 12 of the mutually adjacent sacks and through the sack material located between the stiffening structures 12.

The sacks 10 are provided with a respective holding loop 14 at each of their four upper corners via which the sacks 10 can be gripped.

The outer stiffening structures 12 of the two outwardly arranged sacks in accordance with FIGS. 1 and 2 are not absolutely necessary, but can rather also be omitted to save stiffening structures. Stiffening structures 12 are only absolutely required at those coupling sides of the sacks 10 at which they come into contact with adjacent sacks 10.

At the start of the erection of the flood protection in accordance with the invention, all sacks 10 lie stacked on one another so that the stiffening structures 12 of the sacks 10 extend horizontally. The sack 10 at the outside right of the unit in accordance with FIG. 1 is still located in this position.

To erect the unit in accordance with the invention, the uppermost sack 10 of the stacked sacks 10 is then gripped at its outer holding loops 14 directly at the use location and is pulled away from the sack stack in accordance with FIG. 1 in the direction of the arrow. All the sacks 10 thereby become erect sequentially until they have all adopted their maximum volume. This state is shown in FIG. 2.

The unit of five erected sacks 10 in accordance with FIG. 2 is then held at the outer holding loops 14 of the two outer sacks 10, whereupon the upwardly fully open sacks 10 can be filled with sand, for example. After this filling procedure, the flood protection is completed with respect to the unit shown.

On the dismantling of the flood protection in accordance with FIG. 2, all the sacks 10 can be gripped and raised at their holding loops 14, whereupon the sacks 10 are moved over the load surface of a truck and are cut open at their lower sides. The sand previously in the sacks 10 can thus move without problem onto the load surface of the truck and be reused—as already mentioned.

The three-dimensional view of FIG. 3 shows that the stiffening structures 12 can, for example, have the shape of a substantially square frame 16 which completely spans the coupling sides 18 of the sacks 10.

Alternatively to a frame 16, a cross-shaped stiffening structure 20 in accordance with FIG. 4 can also be used to span the coupling sides 18.

It can be seen particularly graphically from FIGS. 3 and 4 that only the coupling sides 18 are provided with stiffening structures 16, 20, whereas the base and the side faces of the sacks 10 extending perpendicular to the couplings sides 18 are made free of stiffening. The stacking capability of the unfilled sacks in a very small space is thereby made possible.

FIG. 5*a* shows a representation in accordance with FIGS. 3 and 4, with a respective holding loop 14 being arranged in each of the four corner regions of a sack 10 here.

Figure 5B:
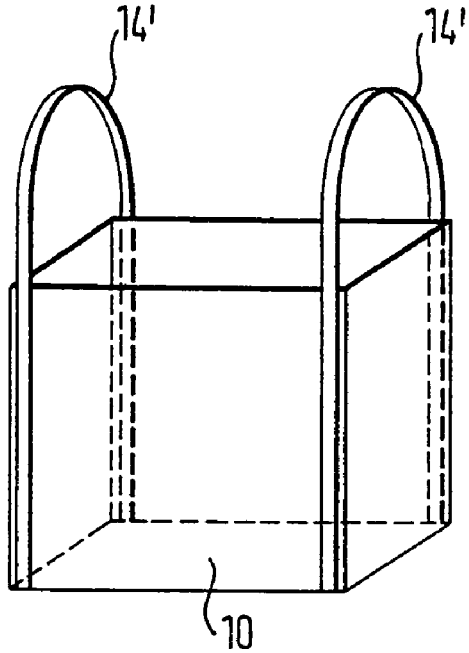

In contrast to this, FIG. 5*b* illustrates a sack 10 which is only equipped with two holding loops 14'. Both holding loops 14' extend parallel to one another from one corner of the open upper side of the sack 10 up to another corner of the open upper side of the sack 10.

Figure 5C:
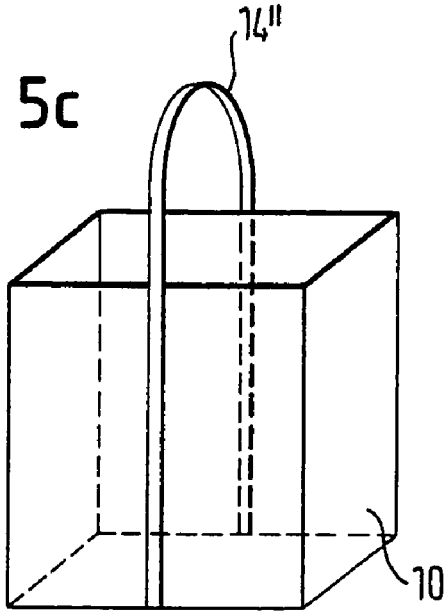

Finally, FIG. 5*c* shows a further alternative embodiment of a sack 10 which only has one single holding loop 14" which extends from the center of an upper marginal side of the sack up to the center of the oppositely disposed upper marginal side of the sack 10.

FIG. 6 shows, in a plan view, an L-shaped arrangement consisting of a total of ten sacks, with this arrangement having a total of two units in accordance with the invention arranged at an angle to one another and each consisting of five sacks 10.

Each of the sacks 10 is equipped on its inner side with two respective stiffening structures 16 which can be made, for example, analog to FIG. 3. The five sacks 10 of each of the two units are coupled to one another in that their stiffening structures 10 which come to lie adjacent to one another are screwed to one another through the sack material. All the stiffening structures of a unit which do not come to lie right at the outside within the unit are thus also already fixedly positioned relative to the sack material before the erection and filling of the unit. Only the two outer stiffening structures 16 of the outermost sacks 10 of a unit are only placed loosely into the sacks prior to the erection of the unit. This makes it possible that these outer stiffening structures 16 do not necessarily have to be arranged at the side of the respective sack 10 disposed opposite the other stiffening structure. It is rather also possible to arrange the two stiffening structures 16 of a sack 10' at mutually adjacent sides of a sack 10' so that they extend at a right angle to one another. With such an arrangement of the stiffening structures 16 shown in the region of the sack 10' of FIG. 6, it is consequently possible to couple a further unit consisting in turn of five sacks 10 at a right angle to a first unit which has the sack 10' as the outermost sack.

Since the material of the sacks 10, 10' is generally flexible, it can also be achieved by a corresponding deformation of the sack 10' that the angle between the two units cannot amount to 90°, but, for example, to more than 90° (up to 180°).

FIG. 7 shows a pyramid-shaped arrangement of flood protection in accordance with the invention made up of a total of three units which each consist of five sacks 10. If a correspondingly higher dam height should be demanded, it is also possible to provided three units as a base, for example, to arrange two further units on these three units and ultimately again one unit on these two units. The flood protection can be enlarged as desired in an analog manner.

The description of the invention is merely exemplary in nature and, thus, variations that do not depart from the gist of the invention are intended to be within the scope of the invention. Such variations are not to be regarded as a departure from the spirit and scope of the invention.

REFERENCE NUMERAL LIST

10 sacks
10' sack
12 stiffening structure
14 holding loops
14' holding loops
14" holding loops
16 frame
18 coupling side
20 cross-shaped stiffening structure

What is claimed is:

1. Flood protection comprising a plurality of fillable sacks (10) made of flexible fabric material, wherein mutually adjacent coupling sides (18) of adjacent sacks (10) are connected to one another in a coupling region; and wherein at least one stiffening structure (12, 16, 20) is associated with each coupling region and extends from the base region of the sacks (10) up to their upper marginal region wherein said mutually adjacent coupling sides 18 of adjacent sacks 10 are connected by means of a force-transmitting connection between the two stiffening structures 12, 16, 20 of the respective coupling side 18, wherein said stiffening structures 12, 16, 20 which are connected to each otter are provided at the inside of the sacks, and wherein each sack 10 is made free of stiffening at those sides which extend perpendicular to the coupling sides 18.

2. Flood protection in accordance with claim 1, wherein mutually adjacent coupling sides (18) of adjacent sacks (10) are connected to one another in that the sack material of the adjacent sacks (10) are coupled to one another, in particular by means of at least one of sewing, and hook and loop connections.

3. Flood protection in accordance with claim 1, wherein mutually adjacent coupling sides (18) of adjacent sacks (10) are connected to one another in that the sack material of the one sack (10) is coupled to the stiffening structure (12, 16, 20) of the other sack (10) in particular by means of at least one of clamps, nails and screws.

4. Flood protection in accordance with claim 1, wherein the at least one stiffening structure (12, 16, 20) extends substantially inside one plane.

5. Flood protection in accordance with claim 1, wherein the at least one stiffening structure (12, 16, 20) substantially completely span the coupling sides (18) of the sacks (10).

6. Flood protection in accordance with claim 1, wherein the at least one stiffening structure (12, 16) has a U shape, with the base of the U shape extending along the upper margin of a coupling side (18) with downwardly extending limbs.

7. Flood protection in accordance with claim 1, wherein the at least one stiffening structure (12, 16) has the shape of a rectangular frame, in particular of a square frame (16).

8. Flood protection in accordance with claim 1, wherein the stiffening structure (12, 20) has a cross-shape or a T-shape.

9. Flood protection in accordance with claim 1, wherein the stiffening structure (12, 16, 20) includes at least one of wood, plastic, paper, cardboard, rubber, natural rubber and metal.

10. Flood protection in accordance with claim 1, wherein the mutually adjacent coupling sides (18) of two sacks (10) are aligned with one another.

11. Flood protection in accordance with claim 1, wherein the sacks (10) substantially have the shape of an upwardly open cube or parallelepiped in their filled state.

12. Flood protection in accordance with claim 1, wherein the sacks (10) have the same sizes among one another.

13. Flood protection in accordance with claim 1, wherein each sack (10) is provided with holding loops (14) in its marginal region adjacent to the open upper side.

14. Flood protection in accordance with claim 13, wherein one respective holding loop (14) is provided in each of the four corner regions of the open upper side.

15. Flood protection in accordance with claim 13, wherein a holding loop (14") extends from the center of an upper marginal side up to the center of the oppositely disposed upper marginal side.

16. Flood protection in accordance with claim 13, wherein two holding loops (14') are provided, with each holding loop (14') extending from one corner of the open upper side up to another corner of the open upper side.

17. Flood protection in accordance with claim 1, wherein the sacks (10) consist of waterproof or water-permeable fabric.

18. Flood protection in accordance with claim 1, wherein the sacks include one of polypropylene fabric and jute.

19. Flood protection in accordance with claim 1, wherein it comprises a plurality of units which in turn each consist of a plurality of sacks (10) coupled to one another in row form.

20. Flood protection in accordance with claim 19, wherein it comprises a plurality of units stacked in pyramid shape.

21. Flood protection in accordance with claim 19, wherein a unit consists of 3 to 10 sacks, in particular of 4 to 6 sacks, and preferably of 5 sacks (10).

22. Flood protection in accordance with claim 19, wherein, with the exception of the two outermost stiffening structures (12) of a unit, all the stiffening structures (12) are connected to the coupling sides (18) associated with them.

23. A method of providing flood protection, comprising:

providing a plurality of fillable sacks (10) made of flexible fabric material;

connecting mutually adjacent coupling sides (18) of adjacent sacks (10) to one another in a coupling region; wherein at least one stiffening structure (12, 16, 20) is associated with each coupling region and extends from the base region of the sacks (10) up to their upper marginal region wherein said mutually adjacent coupling sides 18 of adjacent sacks 10 are connected by means of a force-transmitting connection between the two stiffening structures 12, 16, 20 of the respective coupling side 18, wherein said stiffening structures 12, 16, 20 which are connected to each other are provided at the inside of the sacks, and wherein each sack 10 is made free of stiffening at those sides which extend perpendicular to the coupling sides 18; and introducing filler material into individual sacks (10) in two or more filling steps, with all sacks of a unit first being partly filled in a first filling step and a complete filling only taking place within the framework of at least one further filling step.

24. A method in accordance with claim 23, wherein the filling takes place in at least two steps in that a filler stub or filler tube is moved over mutually adjacent sacks (10) in a first direction, whereupon the filler stub or the filler tube is subsequently moved over the mutually adjacent sacks (10) in a second direction opposite to the first direction.

25. A method of claim 23 further comprising:

individually raising the sacks (10) while destroying the connection present between adjacent sacks;

moving a raised sack (10) over a load surface; and cutting the raised sack (10) open in order thus to empty the respective sack content over the load surface.

* * * * *